US005151884A

United States Patent [19]

Griffith et al.

[11] Patent Number: 5,151,884

[45] Date of Patent: Sep. 29, 1992

[54] CONTROL SYSTEM FOR APPLIANCE INDICATOR LIGHT AND METHOD FOR USING SAME

[75] Inventors: Scott E. Griffith; Barry E. Tuller; Charles L. Jackson, all of Newton, Iowa

[73] Assignee: Maytag Corporation, Newton, Iowa

[21] Appl. No.: 844,148

[22] Filed: Mar. 2, 1992

[51] Int. Cl.[5] ..... G04B 47/00; G06F 15/46

[52] U.S. Cl. ..... 368/10; 134/57 D

[58] Field of Search ..... 368/9, 10; 134/57 R, 134/57 D, 58 R, 58 D

[56] References Cited

U.S. PATENT DOCUMENTS

| | | | |
|---|---|---|---|
| 2,825,348 | 3/1958 | Low | 134/58 |
| 4,068,179 | 1/1978 | Sample et al. | 134/57 D |
| 4,245,310 | 1/1981 | Kiefer | 134/57 D |
| 4,467.423 | 8/1984 | Smith et al. | 134/57 D |
| 4,918,673 | 4/1990 | Stabel | 368/10 |
| 4,939,706 | 7/1990 | Nose | 368/10 |

OTHER PUBLICATIONS

Whirlpool Corporation, "New Generation Dishwashers Compactors" Copyright 1991.

Sears, Roebuck and Co. "Kenmore Dishwashers" 1991.

General Electric Company "Built-In Dishwashers" Aug. 28, 1991.

Caloric Corporation "Caloric Built-In and Portable Dishwashers" Aug. 28, 1991.

*Primary Examiner*—Vit W. Miska

*Attorney, Agent, or Firm*—Zarley, McKee, Thomte, Voorhees, & Sease

[57] ABSTRACT

A control system for an appliance indicator light includes a timer which times the amount of time the appliance door is open after completion of the operational cycle of the appliance. If the door is opened for more than a predetermined period of time, the indicator light will be deactuated, but if the door is opened for less than the predetermined period of time and then reclosed, the indicator light will be left in its on condition. The timer may be a series of cams attached to a motor, a bi-metal switch located adjacent the indicator light, or a microprocessor connected to and driving the indicator light.

17 Claims, 6 Drawing Sheets

CONTROL SYSTEM FOR APPLIANCE INDICATOR LIGHT AND METHOD FOR USING SAME

BACKGROUND OF THE INVENTION

This invention relates to a control system for an appliance indicator light and a method for using same. The invention is particularly useful in dishwasher appliances.

Various devices have been used in dishwashers to indicate when the washing cycle is complete and to indicate when the dishes within the dishwasher are clean. One device used for this purpose in the prior art is a clean indicator light which comes on when the dishwashing cycle is complete, and which indicates to the user that the dishes are clean. In most prior art dishwashers, these clean indicator lights are turned off as soon as the operator opens the dishwasher door and will remain off if the door is reclosed.

However, the users of dishwashers often open the dishwasher to remove a single object without removing all of the clean dishes within the dishwasher. In prior art devices, the opening of the door causes the clean indicator light to go off and remain off, even though the door is sometimes closed with many clean dishes remaining in the dishwasher. There is therefore a need for a clean indicator light which will remain on when the operator opens the door for a short period of time to remove a single item and then recloses the door, without removing all of the clean dishes within the dishwasher.

SUMMARY OF THE INVENTION

Therefore a primary object of the present invention is the provision of an improved control system for an appliance clean indicator light and an improved method for using same.

A further object of the present invention is the provision of a control system which causes the clean indicator light to remain on when the dishwasher door is closed after being open for a short period of time to remove a single object, but which causes the clean indicator light to be deactuated after the dishwasher door has been open for a long period of time to remove all of the clean dishes from within the dishwasher.

A further object of the present invention is the provision of a system for controlling the appliance clean indicator light which is completely automatic.

A further object of the present invention is the provision of an improved control system for an appliance clean indicator light which is economical to manufacture, durable in use, and efficient in operation.

The present invention utilizes a timer which commences operation during the time that the door is open, and which disables the clean indicator light only after the passage of a predetermined amount of time.

The control system for the clean indicator light generally includes a door switch connected to the access door of the appliance. The switch is movable to a first posture in response to the access door being opened and is movable to a second posture in response to the access door being closed. A timer connected to the door switch operates in a first predetermined timing cycle with the access door in its closed position. The timer operates in a second predetermined timing cycle following completion of the first predetermined timing cycle in response to the door switch moving to its first posture. A controller is connected to the timer and a power source for connecting the power source to the clean indicator light during the second predetermined timing cycle and for disconnecting the clean indicator light from the power source on completion of the second predetermined timing cycle.

Three different embodiments of the invention are shown. The first embodiment of the invention utilizes an electric timer motor as a timing device. On the completion of the washing cycle, the timer motor causes a pair of contacts to be closed. The first of these contacts completes a circuit to the clean indicator light, and the second of the contacts completes a circuit to the timer motor. The timer motor is then shut off, and the clean indicator light remains on so long as the dishwasher door is closed. When the dishwasher door is opened, a switch within the dishwasher door completes the electrical circuit to the timer motor, thereby actuating the timer motor. A series of cams are connected to the timer motor, and one of these cams engages and controls a switch between the power source and the clean indicator light. If the door is kept open for a sufficiently long period of time, for example 100 seconds, the cams rotate to a position to cause the circuit to be broken between the power source and the clean indicator light, thereby disabling the clean indicator light. However, if the door is open only for a short time, the closing of the door causes the timer motor to be deactuated before the circuit is broken between the clean indicator light and the power source. Only after the door has been left open for the full 100 seconds do the cams from the timer motor cause the circuit to be broken between the clean indicator light and the power source.

In a second modified form of the invention, the clean indicator light is initially turned on by a circuit actuated by the timer motor. A bi-metal strip switch is then utilized as a timer in place of the timer motor. The bi-metal strip switch is positioned closely adjacent to the clean indicator light, and the heat from the clean indicator light causes the bi-metal strip switch to move to a closed circuit position completing the circuit between the power source and the clean indicator light whenever the door is in its closed position. When the door is moved to its opened position, the circuit is broken to the clean indicator light, but the bi-metal strip switch remains in its closed position for a short period of time. If the dishwasher door is left open a sufficiently long period of time, the bi-metal strip switch will cool and move to its open position, and the closing of the dishwasher door will not reactuate the clean indicator light. However, if the dishwasher door is kept open for a short period of time, the bi-metal strip switch will remain in its closed position, and the closing of the dishwasher door will again complete the circuit to the clean indicator light through the bi-metal strip switch, and cause the clean indicator light to be reactuated.

A third modified form of the present invention utilizes a microprocessor to control the clean indicator light which in this form is a LED. The microprocessor senses when the dishwasher door is open or closed. At the end of the dishwashing cycle, if the dishwasher door is closed, the microprocessor causes the clean indicator light to be actuated. The opening of the dishwasher door triggers a switch which signals to the microprocessor that the door is open, thereby starting a timer within the microprocessor. If the timer is permitted to expire, it disables the clean indicator light so that the clean indicator light will not go on after closing of the dishwasher door. However, if the dishwasher door is left open only for a short period of time and then closed again, the timer within the microprocessor is set back to its beginning value, and the clean indicator light is not disabled.

DESCRIPTION OF THE PREFERRED EMBODIMENT

Figure 1:
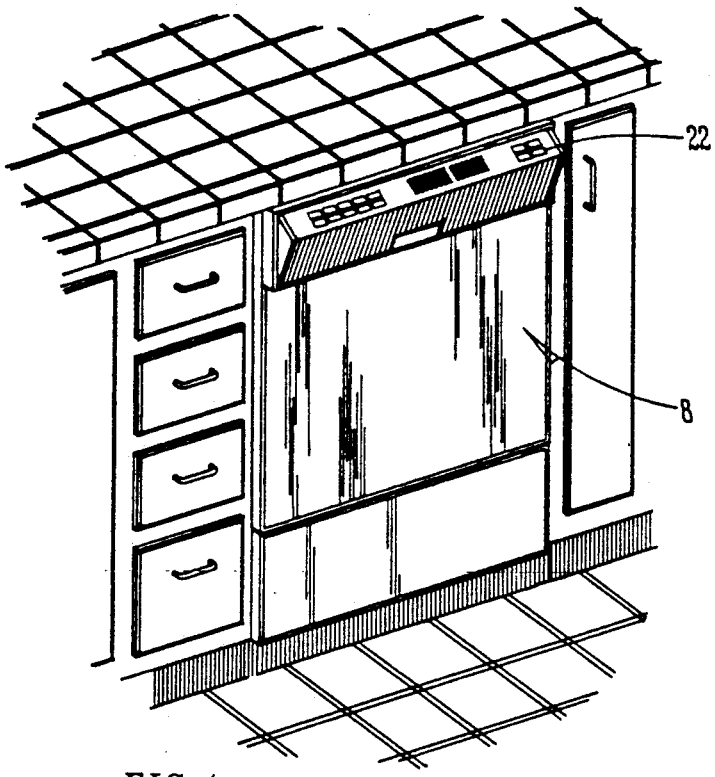
FIG. 1 is a perspective view of a dishwasher installed beneath a kitchen cabinet.
Figure 9:
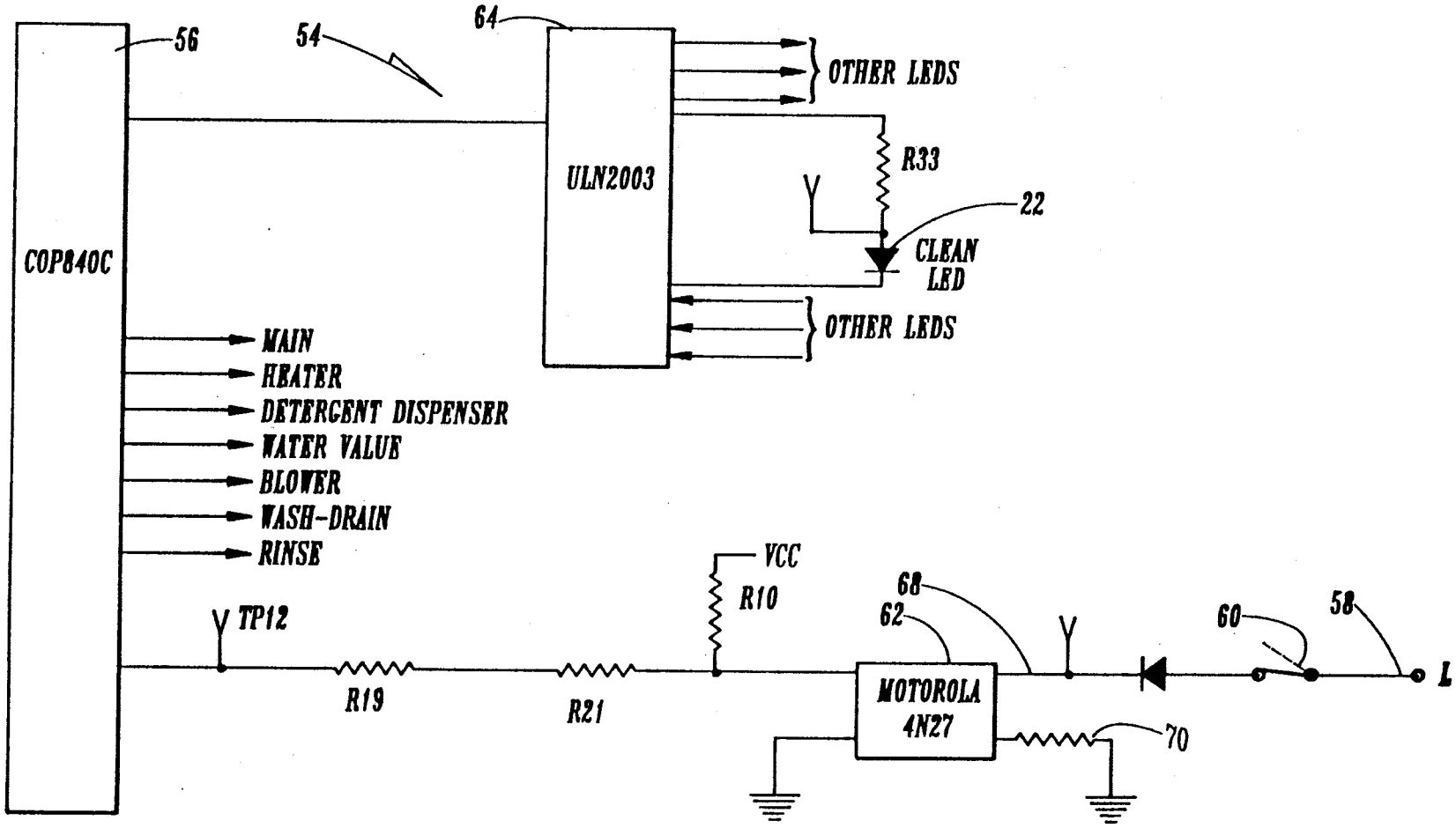
FIG. 9 is a schematic view of a third modified form of the present invention utilizing a microprocessor as a controller for the clean indicator LED.
Figure 10:
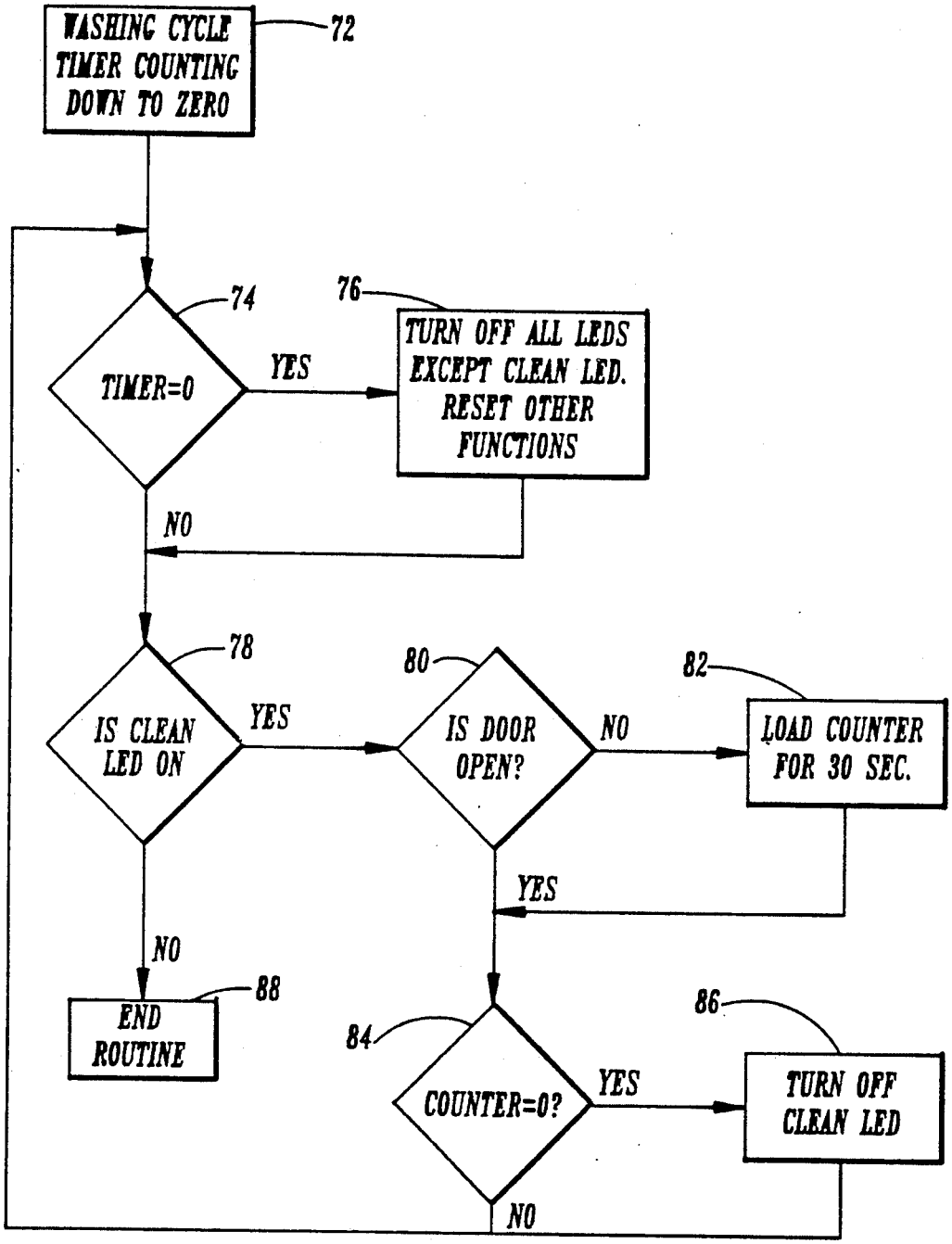
FIG. 10 is a flow chart showing the method of operation of the circuitry in FIG. 9.

FIG. 1 illustrates a conventional dishwasher having a front door 8 and having a clean indicator light 22 on the control panel. In the embodiments shown in FIGS. 1–8, the clean indicator light 22 is preferably an incandescent bulb. In the embodiment of FIGS. 9 and 10, the clean indicator light 22 is preferably a LED. The clean indicator light 22 is adapted to be on after the dishwasher has completed its washing and drying cycle. The purpose of clean indicator light 22 is to indicate that the dishes are clean and ready for removal. The present invention contemplates means for timing the amount of time that the door 8 is open for removal of dishes so that if the door 8 is open for only a short time, the clean indicator light will be on when the door is reclosed. However, if the door 8 is open for a substantial length of time, the timing mechanism of the present invention causes the clean indicator light to be deactuated until after the next cycle so that it will not come on again after the door 8 is closed.

FIGS. 2–5 illustrate a control system 10 for accomplishing the above result. System 10 includes an electrical input line 12 which is connected to a door switch 14 which is connected to door 8, and which is responsive to the opening and closing of the door 8. Switch 14 may be a mercury switch or a mechanical switch and is adapted to move to its upper most position shown in FIGS. 2, 3, and 5 when the door 8 is closed and to its lower most position shown in FIG. 4 when the door 8 is open. System 10 includes a motor switch 16 and a light switch 18 which are shown in their open positions in FIGS. 2 and 5, and which are shown in their closed positions in FIGS. 3 and 4. Switches 16, 18 are controlled by a timer motor 20 which is connected to a cam shaft 26 having a first cam 28, a second cam 30, and a third cam 32 thereon. System 10 also includes clean indicator light 22 and a master washing cycle switch 24. The numeral 34 indicates the neutral or ground wire of the circuit.

Figure 2:
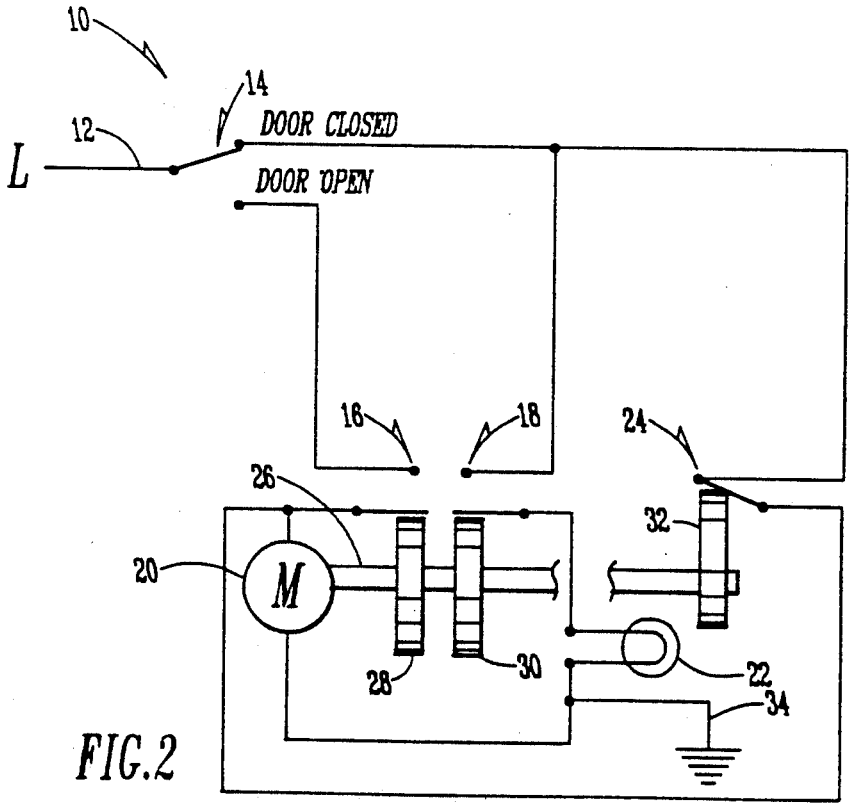
FIG. 2 is a schematic view of one modified form of the present invention utilizing a series of cams to operate the various switches in the circuit.

During the washing and drying cycle of the dishwasher, the third cam 32 is in the position shown in FIG. 2 holding master switch 24 in its closed position. This causes motor 20 to be actuated so that the cam shaft 26 rotates continuously during the washing and drying cycle. Also during the washing and drying cycle, the first and second cams 28, 30 are in the position shown in FIG. 2 causing motor switch 16 and light switch 18 to be in their open positions.

Figure 3:
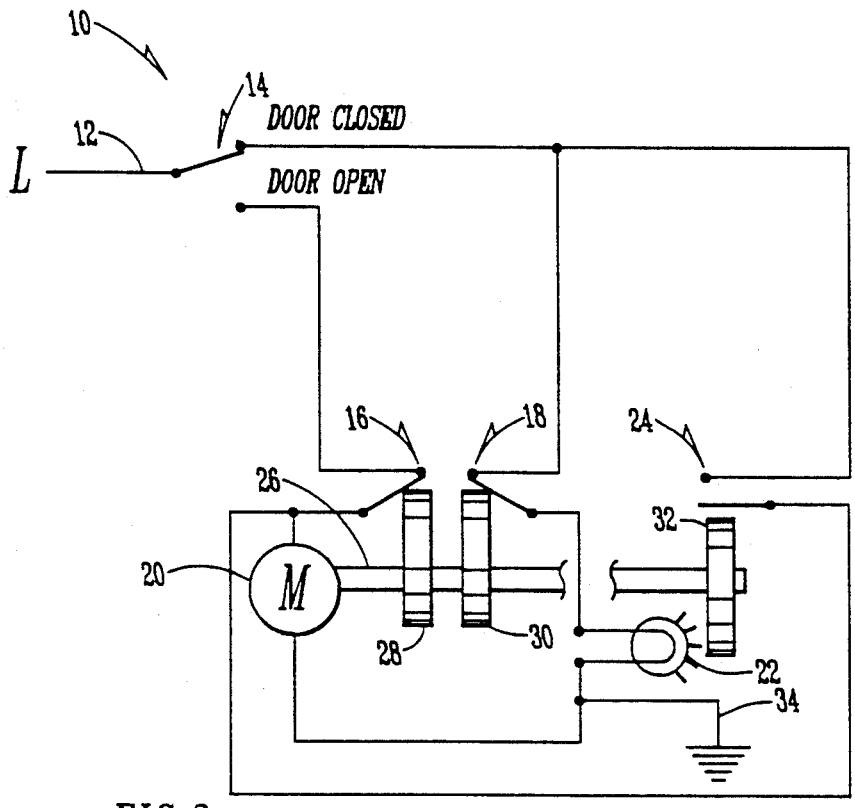
FIG. 3 is a view similar to FIG. 2, showing the cams in a different position.

Upon completion of the washing and drying cycle of the dishwasher, cam 32 has rotated to the position shown in FIG. 3, leaving master switch 24 in its open position and causing motor 20 to be deactuated. At this time, the first and second cams 28, 30 have been moved to the position shown in FIGS. 3 and 4 so as to cause motor switch 16 and light switch 18 to be closed. The closing of light switch 18 causes clean indicator light 22 to come on thereby indicating to the user of the dishwasher that the washing and drying cycle is complete and the dishes are clean. Throughout the washing and drying cycle, the door 8 is in its closed position as shown in both FIGS. 2 and 3.

Figure 4:
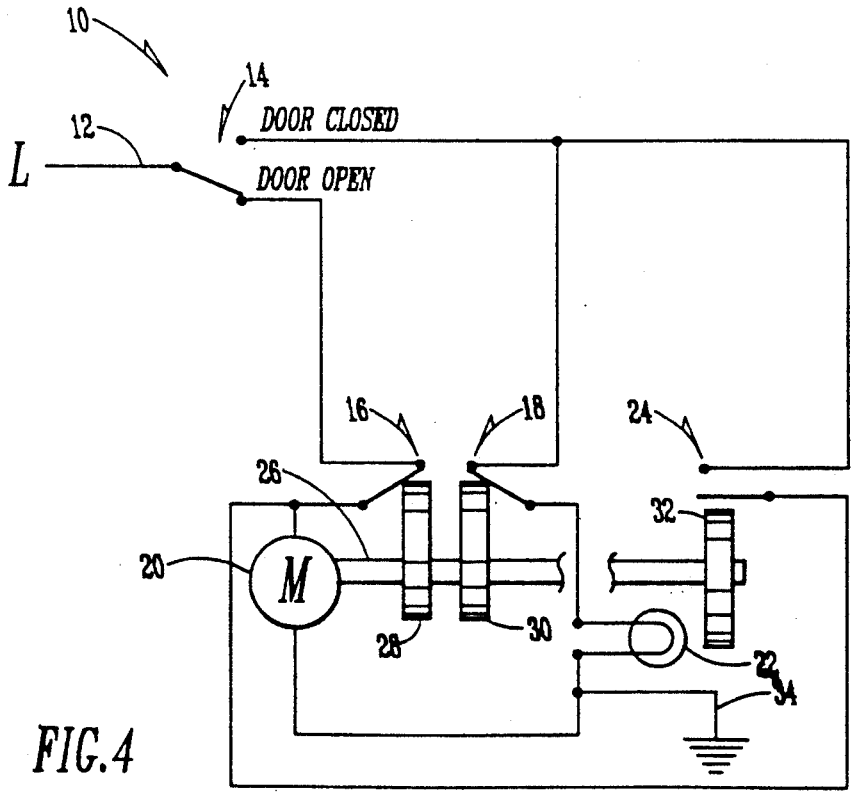
FIG. 4 is a view similar to FIG. 3, but showing the door switch in a different position.

When the operator of the dishwasher desires to remove one or more of the clean dishes from the dishwasher, that person opens the door 8 thereby causing door switch 14 to move from its upper position shown in FIG. 3 to its lower position shown in FIG. 4. Because motor switch 16 is held in its closed position by cam 28, the opening of the door introduces electrical power to the motor 20 thereby actuating motor 20. The actuation of motor 20 causes shaft 26 to begin rotating. The shape of cams 28, 30 is such that the operation of the motor 20 for a period of 100 seconds causes the cams 28, 30, 32 to move from the position shown in FIG. 4 to the position shown in FIG. 5. This results in the opening of switches 16, 18, thereby deactuating the motor 20. As further shown in FIG. 4, when the door 8 is open and the motor 20 is operating, power to the clean indicator light 22 will be interrupted.

Figure 5:
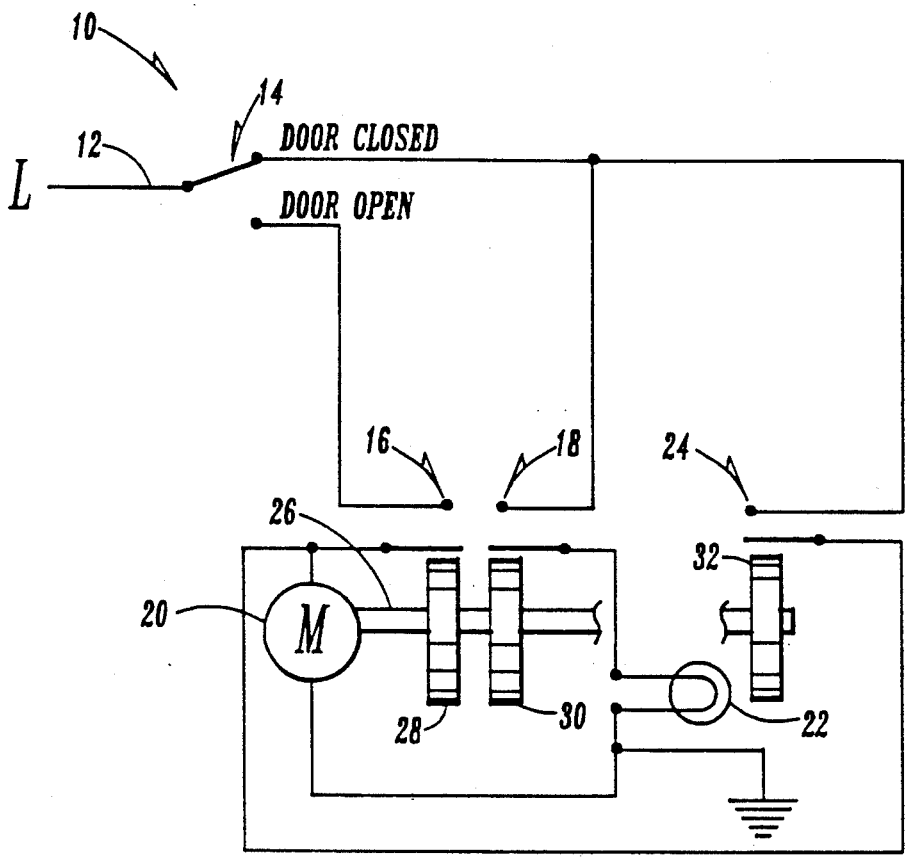
FIG. 5 is a view similar to FIGS. 2–4, but showing the door switch in a closed position and the other switches in an open position.

However, if the door 8 is left open only for a few seconds, as opposed to 100 seconds and then is closed, the motor 20 is shut off before it completes its cycle from the position shown in FIG. 4 to the position shown in FIG. 5. Since the cycle is not complete, the switches 16, 18 remain in their closed position as shown in FIG. 4. This causes the clean indicator light 22 to come on again when door 8 is moved to its closed position to cause door switch 14 to move to its upper position. While the preferred time for the cycle of the clean indicator light 22 is 100 seconds, different cycles can be selected merely by changing the shape of cams 28, 30.

Thus, the system 10 shown in FIGS. 2–5 causes the clean indicator light 22 to return to the on condition if the door 8 is open for a short period of time and is then closed, but causes the clean indicator light 22 to be deactuated if the door 8 is left open for a long period of time. Thus it is possible to remove one or two dishes from the dishwasher, close the door 8, and still have the clean indicator light 22 in an on condition. Only if the door 8 is open for a considerable length of time as would be the case in removal of all the dishes, would the clean indicator light 22 be deactuated.

Figure 6:
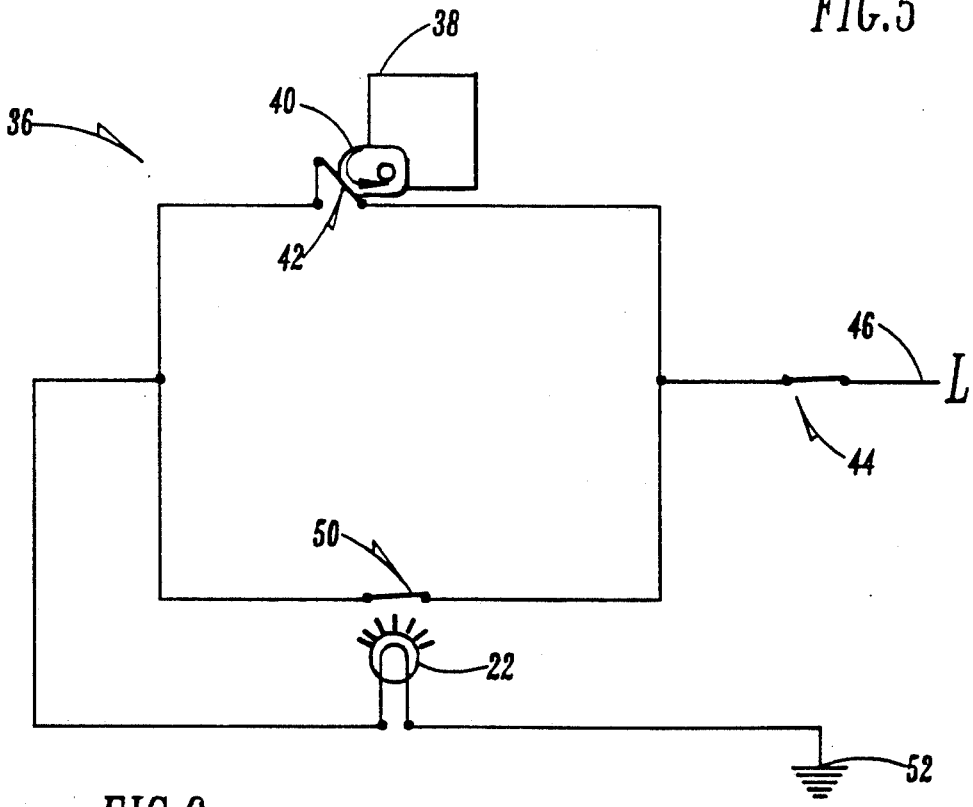
FIG. 6 is a schematic view of a second modified form of the present invention utilizing a bi-metal strip switch as a control switch.
Figure 7:
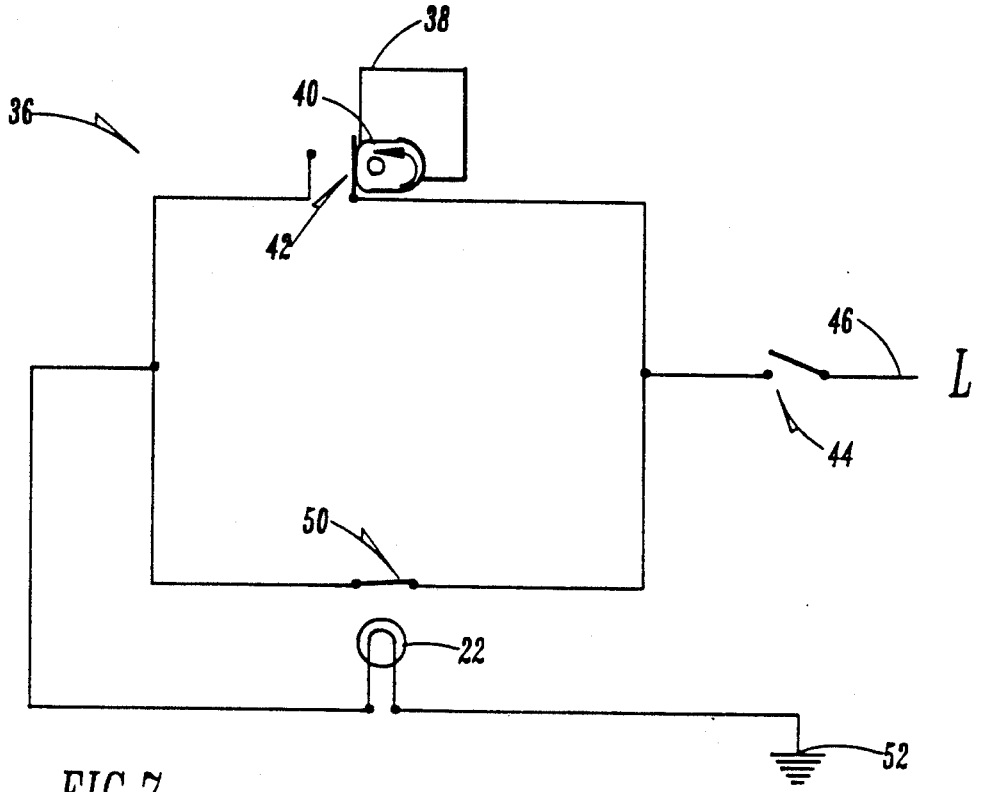
FIG. 7 is a view similar to FIG. 6, but showing the door switch in an open position.
Figure 8:
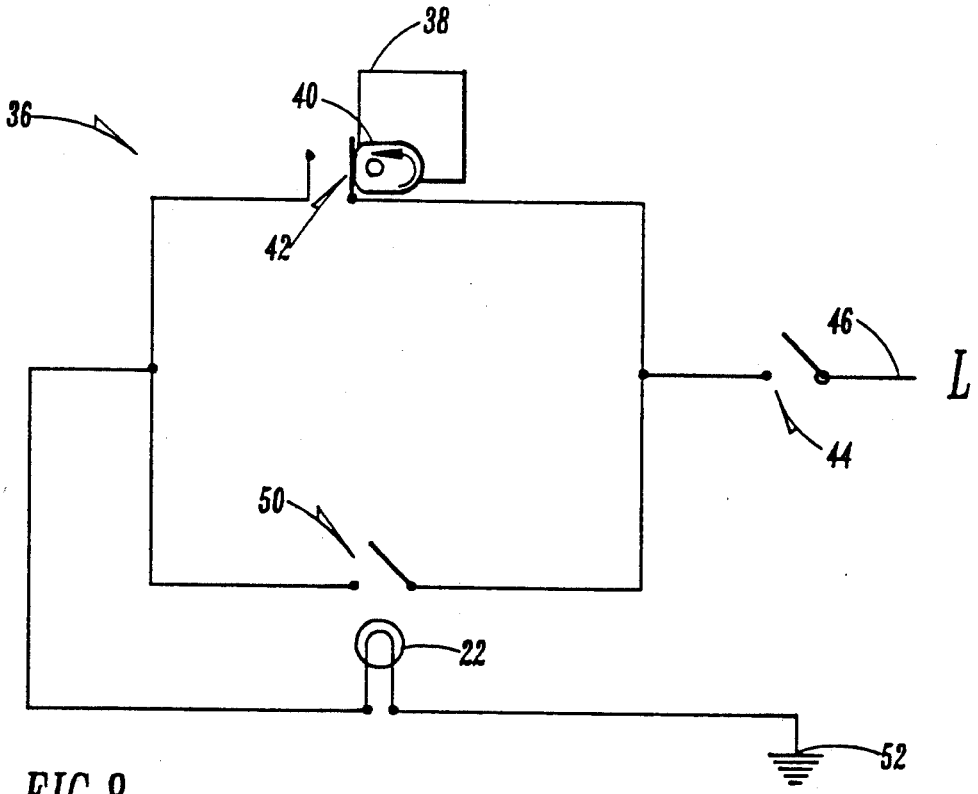
FIG. 8 is a view similar to FIG. 7, but showing both the door switch and the bi-metal strip switch in an open position.

Referring to FIGS. 6–8, a modified system 36 for controlling the clean indicator light 22 is shown. System 36 includes a timer motor 38 which operates a cam 40 in a rotation direction indicated by the arrow on cam 40. Timer motor 38 and cam 40 are timed with the washing and drying cycle of the dishwasher so that cam 40 will move to the position shown in FIG. 6 after the completion of the washing and drying cycle. In the position shown in FIG. 6, cam 40 causes a start switch 42 to be moved to its closed position. A door switch 44 is connected to door 8 and is adapted to be in its closed position when door 8 is also closed. Thus, at the completion of the washing and drying cycle, with switches 42, 44 in their closed positions, electrical power is introduced from an input line 46 to a clean indicator light 22 and ultimately to the ground wire 52. This actuates the clean indicator light 22 which is positioned in close proximity to a bi-metal strip switch 50. Bi-metal strip switch 50 is adapted to be in its open position as shown in FIG. 8 normally, but when bi-metal strip switch 50 is exposed to heat such as the heat emanating from clean indicator light 22, it responds by moving to its closed position shown in FIG. 6. It should also be noted that the motor 38 moves cam 40 to the position of FIG. 6 immediately upon the completion of the washing and drying cycle, but that the motor 38 continues moving cam 40 to the position shown in FIGS. 7 and 8, thereby opening switch 42 shortly after the completion of the washing and drying cycle.

The opening of door 8 to remove one or more dishes, causes switch 44 to move to its open position as shown in FIG. 7. Immediately upon the opening of the door, the clean indicator light 22 is deactuated, but the bi-metal strip switch 50, because of the residual heat which it retains, does not immediately move to its open position. Bi-metal strip switch 50 will only move to its open position after a sufficient amount of time has passed to permit it to cool so that it will move to its open position. Thus, if the dishwasher door 8 is left open only for a short time, the bi-metal strip switch 50 will remain in its closed position, and if the door 8 is closed again after a short period of time, the system resumes its condition as shown in FIG. 6, thereby causing the clean indicator light 22 to return to the on condition.

However, if the dishwasher door 8 is left open for a substantial period of time, the bi-metal strip switch 50 moves to its open position, and the reclosing of the door 8 does not cause the clean indicator light 22 to come on. This condition is shown in FIG. 8.

FIGS. 9 and 10 illustrate a further modified form of the invention designated by the numeral 54. System 54 utilizes a microprocessor 56 manufactured by National Semiconductor under the designation COP840C. The microprocessor 56 is programmed with a program causing it to control all of the various cycles of the dishwasher. The program within microprocessor 56 is also adapted to control the operation of a clean indicator light 22 comprising a LED. System 54 includes a power input line 58 which is connected to a door switch 60 shown in its closed position in FIG. 9, which is the position switch 60 takes when the door 8 is in its closed position. Switch 60 moves to its open position in response to opening of door 8, and the open position of switch 60 is shown in dashed lines in FIG. 9. A door sensor 62 is an opto isolator, and a preferred embodiment of this opto isolator is manufactured by Motorola Company under the designation 4N27. Sensor 62 is connected to door switch 60 and is adapted to sense when a potential of 120 volts is experienced across the inlet line 68 and the outlet line 70 which are connected to sensor 62. Thus, when the switch 60 is in its closed position, the sensor 62 senses a voltage potential of 120 volts, and sends a signal to the microprocessor 56 that the 120 volts has been sensed and the door switch 60 is in its closed position. The program within microprocessor 56 receives this signal and is adapted to process the signal for controlling a LED driver 64 which drives clean indicator light 22. The LED driver 64 is manufactured by Sprague Company under the designation ULN 2003.

FIG. 10 illustrates the process by which the computer program in microprocessor 56 operates. The program controls the washing cycle and the drying cycle, and includes a counter which counts down to zero when the washing and drying cycles are complete. This step in the process is indicated by the box 72 in FIG. 10. The microprocessor 56 then senses whether or not the timing counter is down to zero as indicated by the diamond shape box 74. If the program determines that the counter has reached zero, it turns off all of the LEDs on the control panel of the dishwasher except for the LED comprising the clean indicator light 22. The computer program then checks to determine whether or not the clean LED is in fact still on, and this step is indicated by the diamond shape box 78. If the clean LED is on, the program then checks to see if door 8 is open, and this is accomplished by responding to the signal from door sensor 62. If door sensor 62 indicates that the door 8 is closed, the computer program loads a timing counter for 30 seconds as indicated in box 82. The program then immediately checks to see if the counter is at zero, and because the counter was loaded immediately preceding this, diamond shape box 84 will indicate that the counter is not at zero and will return to the top of the cycle above box 74. The program will then go through the steps outlined in boxes 74, 78, 80 and 82 so long as the door switch 60 is in its closed position. Each time the program reaches the step shown in box 82, it reloads the counter for another 30 seconds, and because it takes less than 30 seconds for the cycle to be complete, the counter never registers zero so long as the door 8 remains in its closed position.

When the operator opens the door 8 for a short period of time, the program bypasses the step of box 82, and continues through box 84 back to box 74 so long as the door 8 is open. If the door 8 is open for less than 30 seconds, and then is closed, the program goes from box 80 to box 82, thereby reloading the counter and preventing the clean LED of clean indicator light 22 from going off. However, if the door 8 is open for more than 30 seconds, the counter reaches zero, and when the program reaches box 84, it senses a zero in that counter and turns off the clean LED of clean indicator light 22.

Thus, the system shown in FIGS. 9 and 10 causes the clean LED of the clean indicator light 22 to remain on so long as the door 8 is kept open less than 30 seconds, but if the door 8 is open for 30 seconds or more, then the clean LED of clean indicator light 22 is turned off. The present invention insures that the clean indicator light 22 will remain on if the operator opens the door 8 for a short period of time to remove a few dishes and then recloses the door 8. However, if the operator opens the door 8 for sufficient length of time to remove all of the dishes, then the clean indicator light 22 is deactuated and remains off. The device is simple and economical to manufacture, and is efficient in its operation.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. A control system for controlling an indicator light for an appliance after said appliance has completed an operational cycle, said appliance having an access door being in a closed position during said operational cycle and movable to an open position, said control system comprising:

an electrical power source;

door switch means connected to said power source and being movable to a first posture in response to said door being moved to said open position and being movable to a second posture in response to said door being moved to said closed position;

timing means connected to said door switch and being operable responsive to said door switch moving to said first posture after completion of said operational cycle for causing initiation of a timing cycle which continues for a predetermined period of time;

controller means connected to said timing means and said power source for connecting said power source to said indicator light until said timing means completes said timing cycle, and for disconnecting said indicator light from said power source when said timing means completes said timing cycle.

2. A control system according to claim 1 wherein said timing means comprises a bi-metal strip switch.

3. A control system according to claim 2 wherein said bi-metal strip switch is positioned adjacent said indicator light and is responsive to heat emanating from said indicator light to move from an open position to a closed position and is responsive to the absence of heat emanating from said indicator light to return to said open position.

4. A control system according to claim 3 wherein said bi-metal strip switch completes a circuit from said power source to said indicator light when in said closed position and creates an open circuit between said power source and said indicator light when in said open position.

5. A control system according to claim 4 wherein said controller means comprises a controller switch connected between said power source and said indicator light and after completion of said operational cycle being adapted to move from a closed position connecting said power source to said indicator light to an open position disconnecting said power source from said indicator light through said controller switch.

6. A control system according to claim 5 wherein said controller means further comprises actuator means for selectively moving said controller switch between its said open and closed positions.

7. A control system according to claim 1 wherein said timing means comprises a timer motor.

8. A control system according to claim 7 wherein said controller means comprises a first switch between said timer motor and said power source and being movable from a closed position actuating said timer motor and an open position deactuating said timer motor.

9. A control system according to claim 8 wherein said controller means further comprises a second switch between said indicator light and said power source, said second switch being movable from a closed position connecting said indicator light to said power source to an open position disconnecting said indicator light from said power source.

10. A control system according to claim 9 wherein said timing means further comprises cam means drivingly connected to said timer motor and engageable with said first and second switches for moving in response to actuation of said timer motor to cause said first and second switches to move between their said open and closed positions according to a predetermined pattern throughout said timing cycle.

11. A control system according to claim 10 wherein said controller means still further comprises a third switch between said timer motor and said power source and being movable from a closed position for actuating said timer motor to an open position preventing actuation of said timer motor through said third switch.

12. A control system according to claim 11 wherein said cam means is engageable with said third switch means for causing said third switch means to move from said closed to said open position when said first and second switches are moved by said cam means to their said closed positions respectively.

13. A control system according to claim 1 comprising a microprocessor connected between said door switch means and said indicator light, and being programmed with a computer program, said timing means comprising a timing portion of said program and said controller means comprising a controller portion of said program.

14. A control system for controlling an indicator light for an appliance after said appliance has completed an operational cycle, said appliance having an access door being in a closed position during said operational cycle and movable to an open position, said control system comprising:

door switch means movable to a first posture when said door is in said open position and being movable to a second posture when said door is in said closed position;

computer means connected to said door switch and said indicator light, said computer means being programmed with a computer program which causes said computer means to actuate said indicator light upon completion of said operational cycle of said appliance and to remain in said actuated condition for a predetermined period of time after said door is moved to said open position, said computer program causing said computer means to turn said indicator light to a deactuated condition after said door has been in said open position for said predetermined period of time.

15. A control system for controlling an indicator light for an appliance, said appliance having an access door movable between an open position and a closed position, said control system comprising:

an electrical power source;

door switch means connected to said power source and being movable to a first posture in response to said door being moved to said open position and being movable to a second posture in response to said door being moved to said closed position;

timing means connected to said door switch and operable in a first predetermined timing cycle with said access door in said closed position, said timing means further operable in a second predetermined timing cycle following completion of said first predetermined timing cycle responsive to said door switch moving to said first posture;

controller means connected to said timing means and said power source for connecting said power source to said indicator light during said second predetermined timing cycle, and for disconnecting said indicator light from said power source on completion of said second predetermined timing cycle.

16. A control system according to claim 15 wherein said first predetermined timing cycle comprises an operational cycle for said appliance.

17. A method for controlling an indicator light for an appliance after said appliance has completed an operational cycle, said appliance having an access door being in a closed position during said operational cycle and being movable from said closed position to an open position, said method comprising:

enabling an electrical circuit containing said indicator light after completion of said operational cycle of said appliance whereby said indicator light will be in an actuated condition;

sensing when said door is moved to said closed position and when said door is moved to said open position;

starting timer means in response to said door being moved to said open position, said timer means being adapted to move through a timing cycle in a predetermined time interval;

preventing said timer means from reaching completion of said timing cycle whenever said door is moved to said closed position before said timer means completes said timing cycle;

disabling said electrical circuit containing said indicator light whenever said timer means completes said timing cycle whereby said indicator light will be in a deactuated condition.

* * * * *